US009540139B2

(12) United States Patent
Baltz

(10) Patent No.: US 9,540,139 B2
(45) Date of Patent: Jan. 10, 2017

(54) PALLET AND WRAP THEREFOR

(71) Applicant: Rehrig Pacific Company, Los Angeles, CA (US)

(72) Inventor: Kyle L. Baltz, Rossmoor, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 14/266,068

(22) Filed: Apr. 30, 2014

(65) Prior Publication Data

US 2014/0319302 A1 Oct. 30, 2014

Related U.S. Application Data

(60) Provisional application No. 61/817,821, filed on Apr. 30, 2013, provisional application No. 61/856,361, filed on Jul. 19, 2013.

(51) Int. Cl.

| | |
|---|---|
| ***A47B 91/00*** | (2006.01) |
| ***B65D 19/38*** | (2006.01) |
| ***B65D 19/00*** | (2006.01) |
| ***B65D 65/02*** | (2006.01) |

(52) U.S. Cl.

CPC ..... *B65D 19/385* (2013.01); *B65D 19/004* (2013.01); *B65D 65/02* (2013.01); *B65D 2519/00034* (2013.01); *B65D 2519/00069* (2013.01); *B65D 2519/0081* (2013.01); *B65D 2519/0094* (2013.01); *B65D 2519/0097* (2013.01); *B65D 2519/00233* (2013.01); *B65D 2519/00243* (2013.01); *B65D 2519/00268* (2013.01); *B65D 2519/00273* (2013.01); *B65D 2519/00288* (2013.01); *B65D 2519/00318* (2013.01); *B65D 2519/00338* (2013.01); *B65D 2519/00681* (2013.01)

(58) Field of Classification Search

CPC . B65D 19/0053; B65D 19/0075; B65D 19/18; B65D 19/12; B65D 19/385; B61D 45/00

See application file for complete search history.

(56) References Cited

U.S. PATENT DOCUMENTS

| | | | | |
|---|---|---|---|---|
| 2,046,095 A * | 6/1936 | Thomas | 211/85.17 |
| 2,539,997 A * | 1/1951 | Graves | B60R 9/048 224/322 |
| 2,692,064 A * | 10/1954 | Koester | B65D 19/14 108/55.1 |
| 2,956,763 A | 10/1960 | D'Arca | |
| 3,173,539 A * | 3/1965 | Looker | B65D 19/44 206/597 |

(Continued)

FOREIGN PATENT DOCUMENTS

| | | |
|---|---|---|
| EP | 254947 A2 | 2/1988 |
| EP | 742886 B1 | 10/2004 |

(Continued)

*Primary Examiner* — Amy Sterling

(74) *Attorney, Agent, or Firm* — Carlson, Gaskey & Olds

(57) ABSTRACT

A pallet includes a deck and a plurality of supports below the deck. The pallet includes at least one frame extending upward from the deck. The at least one frame is pivotably secured to the deck, such that the at least one frame is pivotable from an upright position to a collapsed position. The deck may include at least one recess for receiving the at least one frame in the collapsed position.

19 Claims, 21 Drawing Sheets

(56) References Cited

U.S. PATENT DOCUMENTS

| | | | | |
|---|---|---|---|---|
| 3,499,398 | A * | 3/1970 | Murray | 108/53.5 |
| 3,565,018 | A | 2/1971 | Jay | |
| 3,620,388 | A | 11/1971 | Mansson Harry | |
| 3,664,273 | A | 5/1972 | Howe | |
| 3,753,407 | A * | 8/1973 | Tilseth | 108/53.3 |
| 3,961,585 | A * | 6/1976 | Brewer | B60P 7/0876 294/77 |
| 4,074,401 | A * | 2/1978 | Spinosa | A44B 11/28 24/600.9 |
| 4,186,841 | A | 2/1980 | Buckley et al. | |
| 5,076,457 | A | 12/1991 | Marovskis | |
| 5,279,505 | A * | 1/1994 | Goudreau et al. | 439/37 |
| 5,533,456 | A * | 7/1996 | Regina | 108/57.29 |
| 5,638,642 | A | 6/1997 | Nemec | |
| 5,787,817 | A * | 8/1998 | Heil | B65D 19/44 108/51.11 |
| 5,941,398 | A * | 8/1999 | Harris | 211/60.1 |
| 6,050,419 | A | 4/2000 | Flanagan et al. | |
| 6,273,006 | B1 * | 8/2001 | Reutter | B65D 19/004 108/53.1 |
| 6,279,763 | B1 | 8/2001 | Bush | |
| 6,325,224 | B1 | 12/2001 | Brown | |
| RE38,076 | E * | 4/2003 | Brennan et al. | 108/53.1 |
| 6,929,438 | B1 | 8/2005 | Foster et al. | |
| 7,044,065 | B2 * | 5/2006 | Arai et al. | 108/53.1 |
| 7,044,066 | B1 * | 5/2006 | Miller | B65D 19/44 108/54.1 |
| 7,717,657 | B2 * | 5/2010 | Clarke | B65D 71/0096 410/34 |
| 7,802,526 | B2 * | 9/2010 | Brady et al. | 108/53.5 |
| 7,934,894 | B1 | 5/2011 | Temple | |
| 8,250,835 | B2 | 8/2012 | Kenneally | |
| 2004/0149619 | A1 | 8/2004 | Dybro et al. | |
| 2008/0302544 | A1 | 12/2008 | Eskind et al. | |
| 2008/0308015 | A1 * | 12/2008 | Apps | 108/53.3 |
| 2011/0049164 | A1 | 3/2011 | Banks et al. | |

FOREIGN PATENT DOCUMENTS

| | | |
|---|---|---|
| EP | 2465784 A2 | 6/2012 |
| EP | 2200904 B1 | 6/2013 |
| WO | 9510378 A1 | 4/1995 |

* cited by examiner

PALLET AND WRAP THEREFOR

BACKGROUND

Pallets generally include a deck supported above a floor by a plurality of supports or feet. The pallet may be nestable, such that the feet of one pallet can fit into complementary recesses on an identical pallet stacked therebelow when the pallets are empty.

Sometimes the pallets are loaded with goods on which another pallet cannot be stacked. For example, the goods on the pallet may be too fragile to support the weight of another pallet (or more than one) loaded with goods. Alternatively, the goods on the pallet may be different sizes, such that a level upper surface is not provided by the goods stacked thereon.

SUMMARY

A pallet includes a deck and a plurality of supports below the deck. The pallet includes at least one frame extending upward from the deck. The at least one frame is pivotably secured to the deck, such that the at least one frame is pivotable from an upright position to a collapsed position. The deck may include at least one recess for receiving the at least one frame in the collapsed position.

In another feature, a flexible wrap may be secured to the pallet deck above the goods stacked thereon. Connectors may be provided about the periphery of the deck to removably secure the wrap to the deck over the goods.

DESCRIPTION OF PREFERRED EMBODIMENTS

Figure 1:
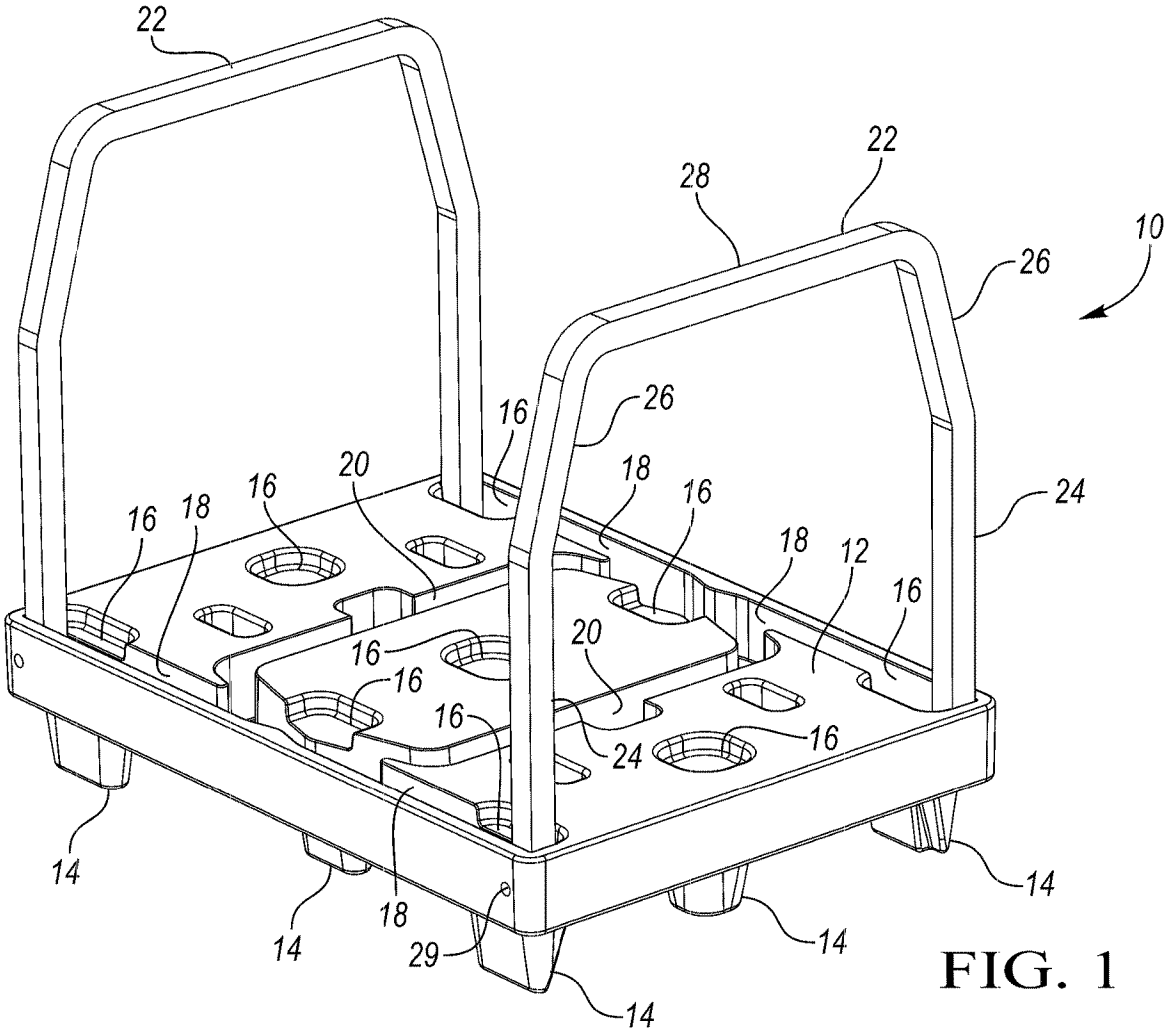
FIG. 1 is a perspective view of a pallet according to a first embodiment.

A pallet 10 according to one embodiment is shown in FIGS. 1-19. Referring to FIG. 1, the pallet 10 includes a deck 12 supported above the ground by supports or feet 14. Pockets 16 are formed in an upper surface of the deck 12 for receiving the feet 14 of an identical pallet 10 to provide partial nesting when empty. Alternatively, deeper pockets 16 could be provided to provide more significant nesting, such as where most or substantially all of each foot 14 can be received in a pocket 16.

Long channels 18 are formed in the deck 12 along each long edge of the deck 12. A pair of cross-channels 20 are formed in the deck 12, generally perpendicular to the long channels 18. As shown in FIG. 1, the pallet 10 includes a pair of frames 22 extending upward from each end of the deck 12. Each frame 22 includes a pair of upright or vertical portions 24, each extending upward from a corner of the deck 12. A cross portion may include a pair of angled portions 26 and a middle portion 28. An angled portion 26 extends upward and inward from the upper end of each vertical portion 24. The horizontal or middle portion 28 connects the angled portions 26 of each frame 22. A lower end of each vertical portion 24 is pivotably connected to the deck 12 by a hinge 29.

Figure 3:
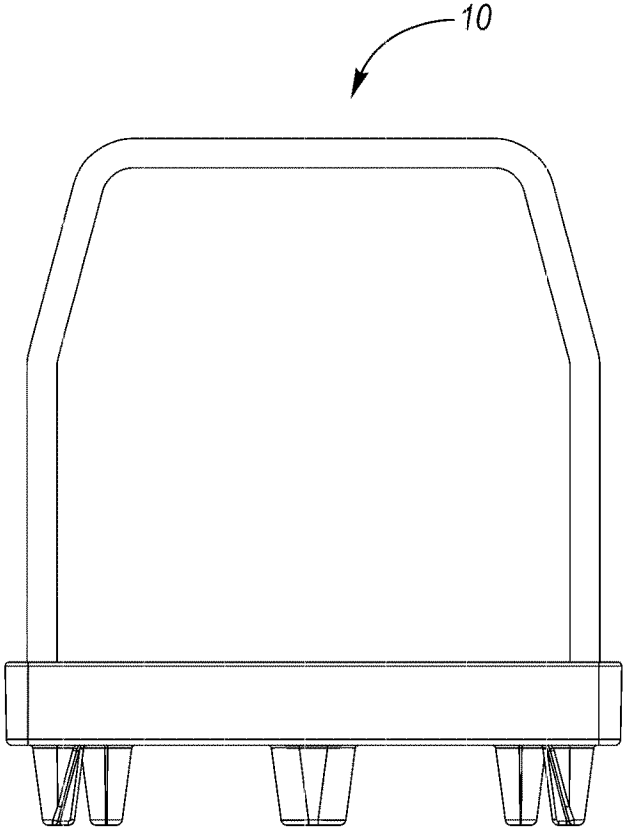
FIG. 3 is an end view of the pallet of FIG. 1.
Figure 2:
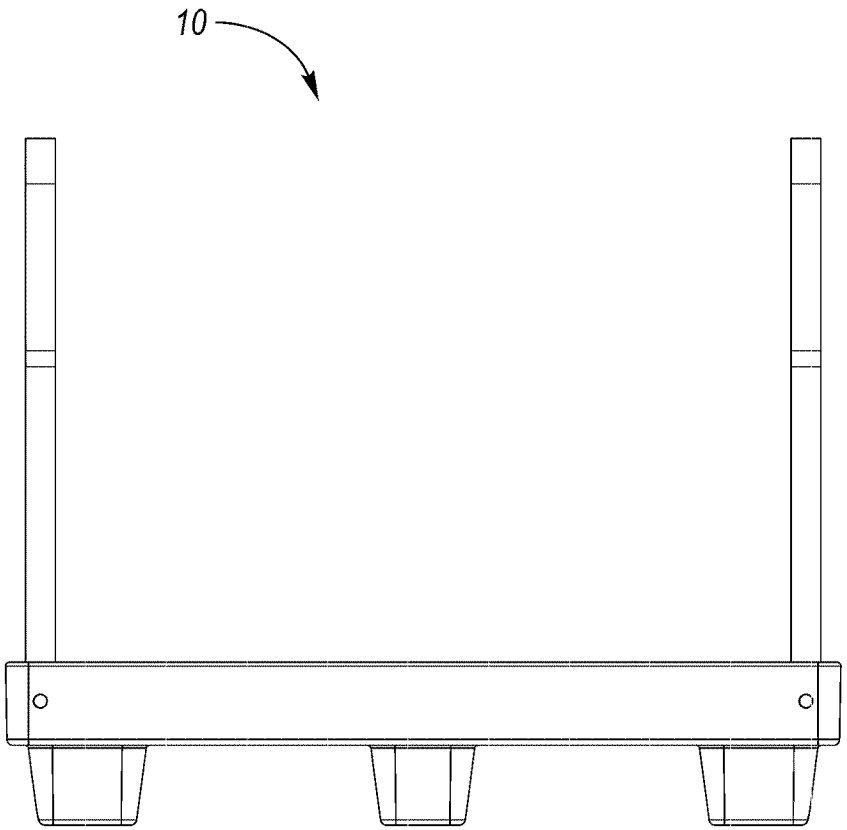
FIG. 2 is a side view of the pallet of FIG. 1.

FIG. 2 is a side view of the pallet 10. FIG. 3 is an end view of the pallet 10.

Figure 4:
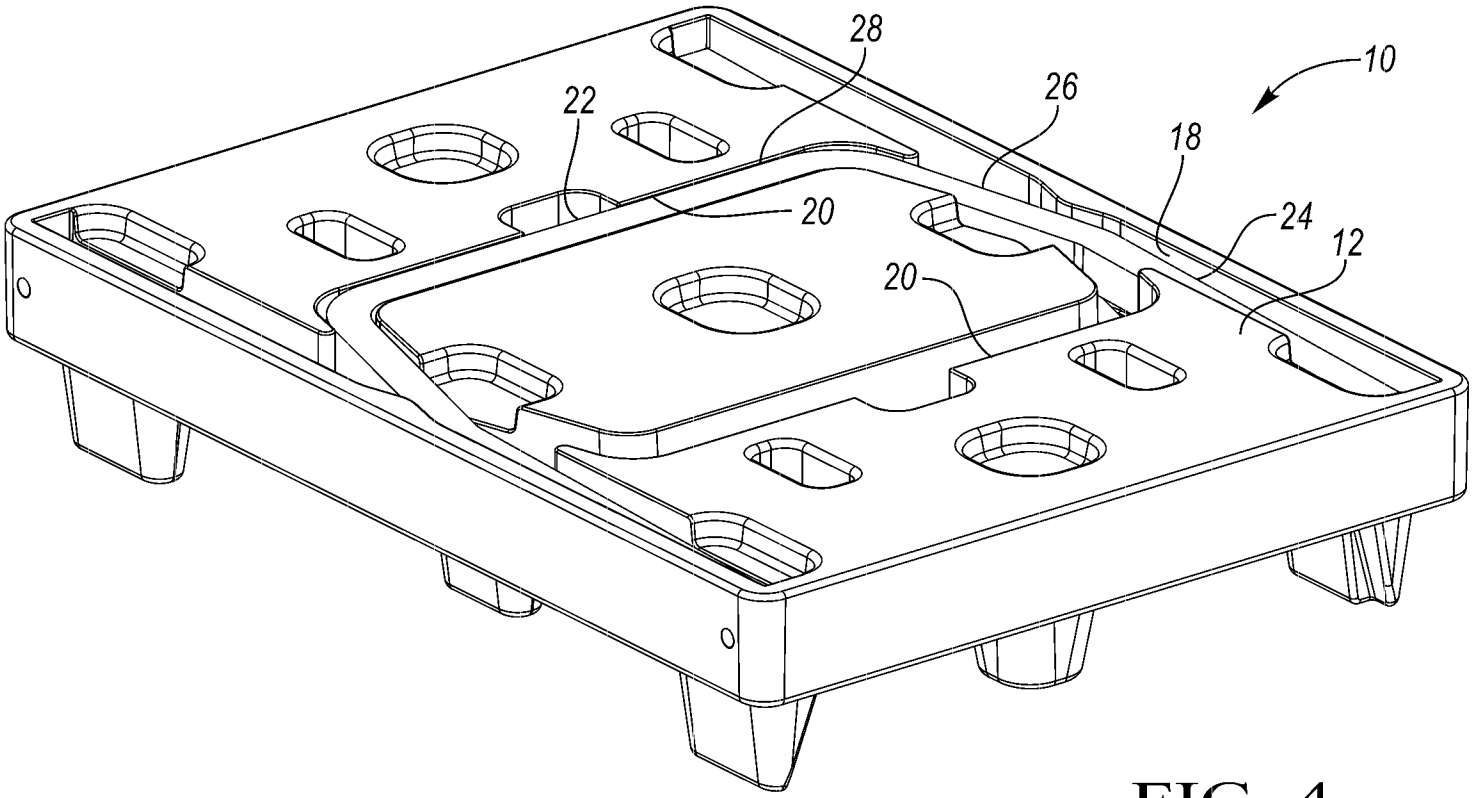
FIG. 4 shows the frames in a collapsed position of the pallet of FIG. 1.
Figure 5:
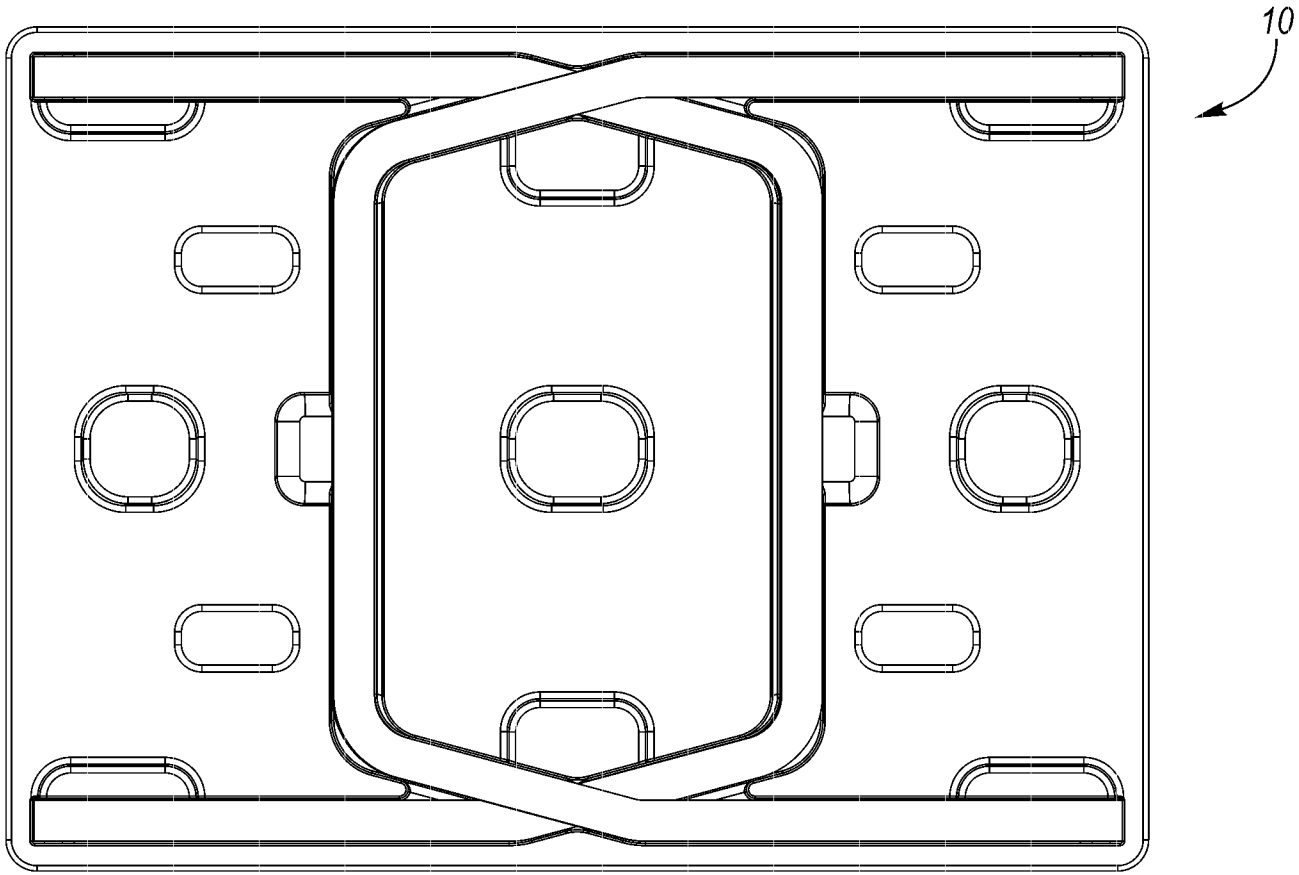
FIG. 5 is a top view of the pallet of FIG. 4.

FIG. 4 shows the frames 22 in a collapsed position, pivoted down into the channels 18, 20 in the deck 12. Preferably, in the collapsed position, the frames 22 do not protrude above the upper, support surface of the deck 12. The first folded-down frame 22 lies substantially within the long channels 18 and cross channel 20 in the deck 12. The second folded-down frame 22 may overlap with the first frame 22, as shown, but also preferably remains within the long channels 18 and cross channel 20 in the deck 12. FIG. 5 is a top view of the pallet 10 of FIG. 4.

Figure 6:
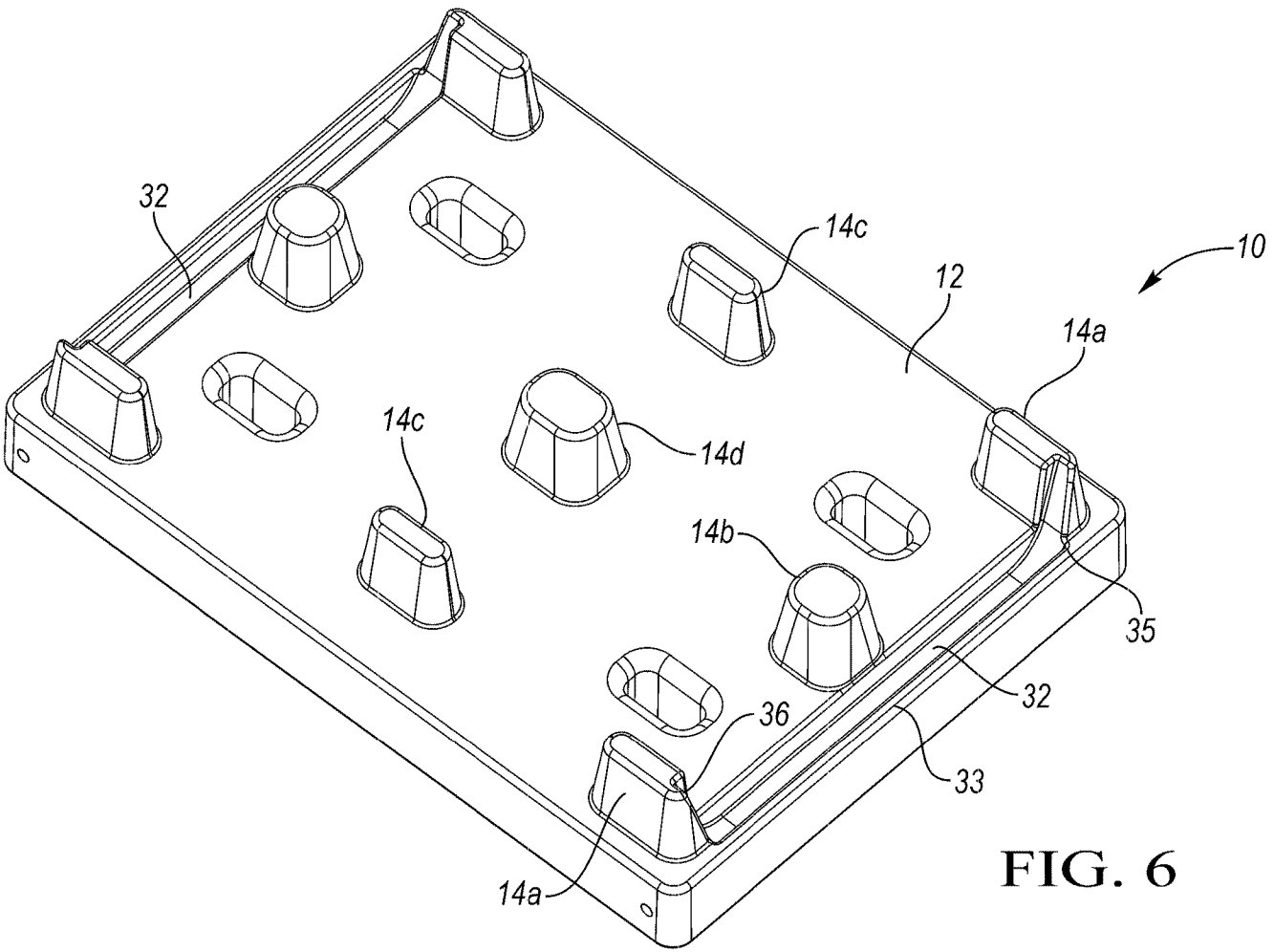
FIG. 6 is a bottom perspective view of the pallet of FIG. 4.

FIG. 6 is a bottom perspective view of the pallet 10. For clarity, the feet 14 are generally referenced with reference numeral "14" but individual feet are referenced with the numeral "14" with a letter appended thereto. A recess or channel 32 is formed along each end edge (or "short edge") of the lower surface of deck 12. A lip 33 is formed between the channel 32 and each end edge. The channel 32 is defined between the lip 33 and a center end foot 14*b*. The channel 32 is defined between corner feet 14*a*. A corner recess 35 continuous with the channel 32 is formed in each corner foot 14*a*. Between the end edges, feet 14*c* are spaced inward from the side edges of the deck 12 further than are the corner feet 14*a*. This is to accommodate the long channels 18 formed in the upper surface of the deck 12 (FIG. 1).

Figure 7:
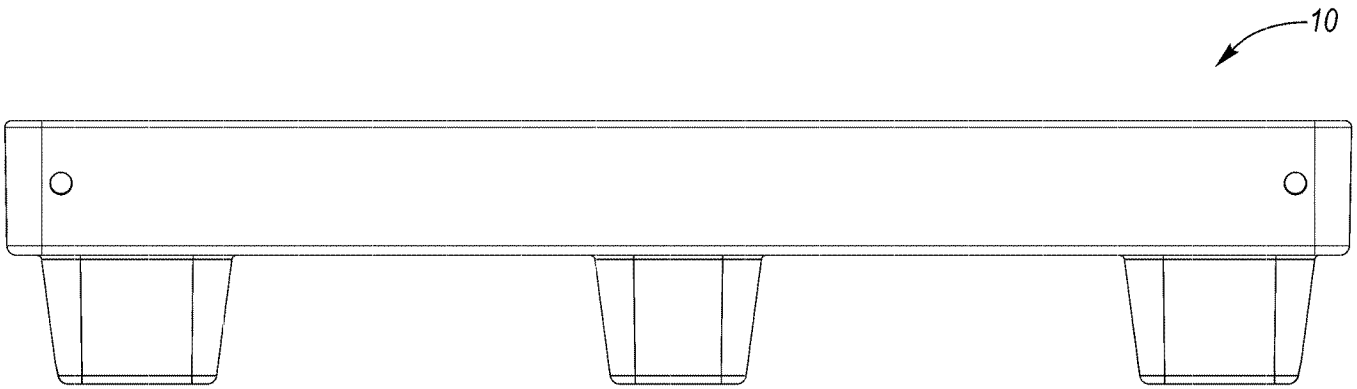
FIG. 7 is a side view of the pallet of FIG. 4.
Figure 8:
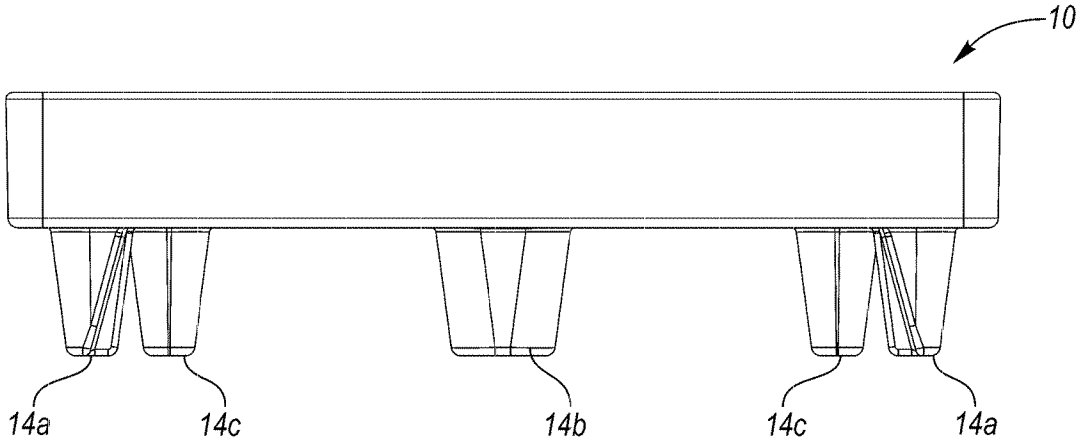
FIG. 8 is an end view of the pallet of FIG. 4.

FIG. 7 is a side view of the pallet 10. FIG. 8 is an end view of the pallet 10.

Figure 9:
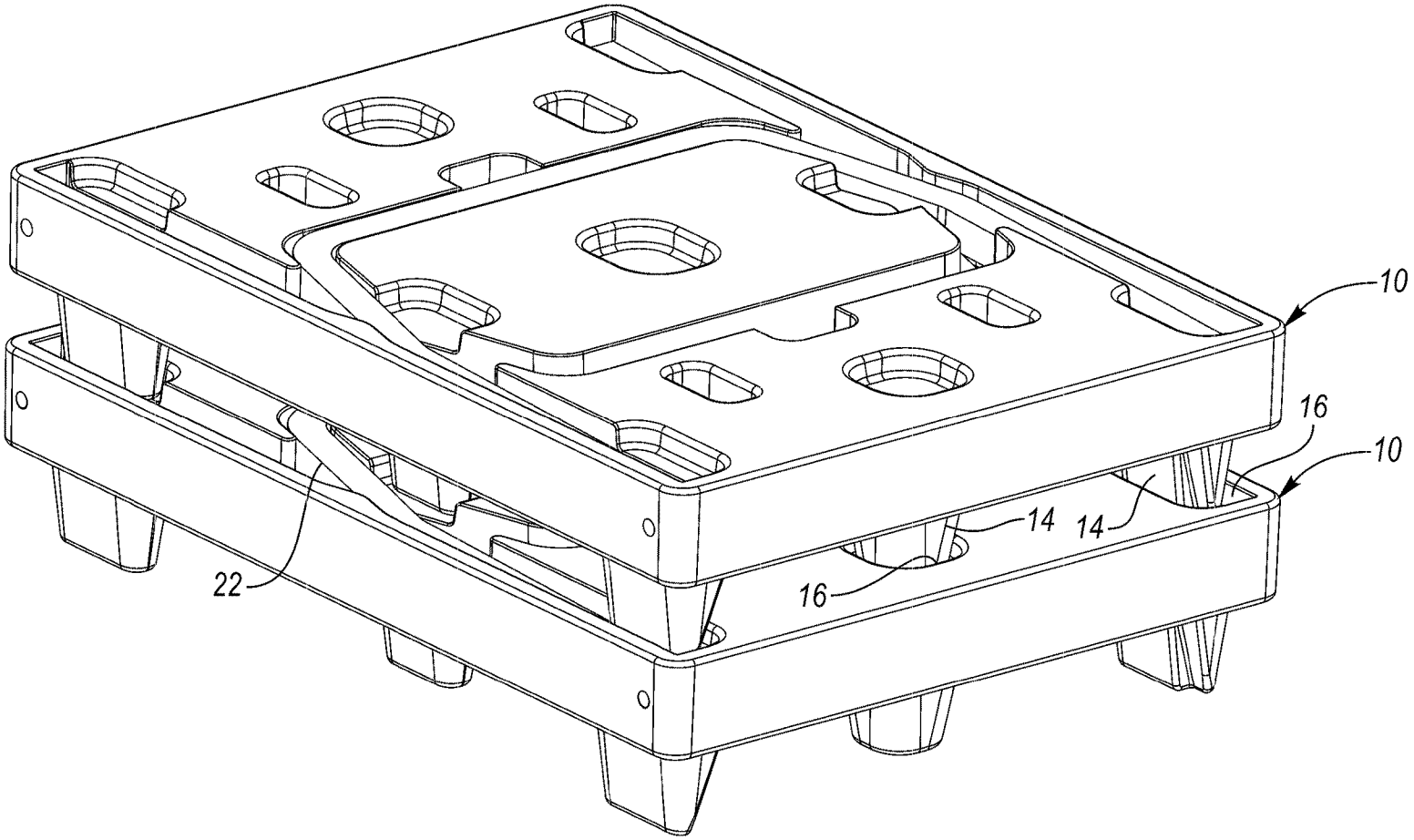
FIG. 9 is a perspective view of the pallet of FIG. 4 with an identical pallet stacked thereon.
Figure 10:
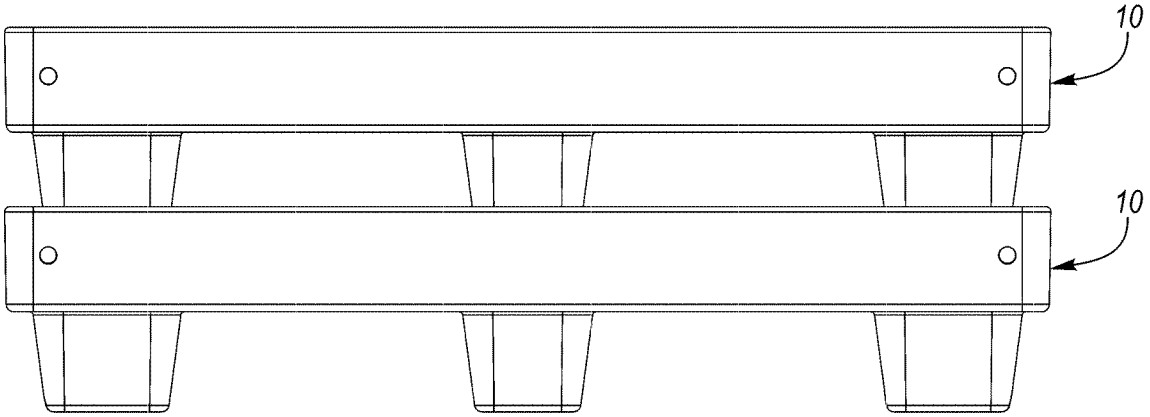
FIG. 10 is a side view of the pallets of FIG. 9.
Figure 11:
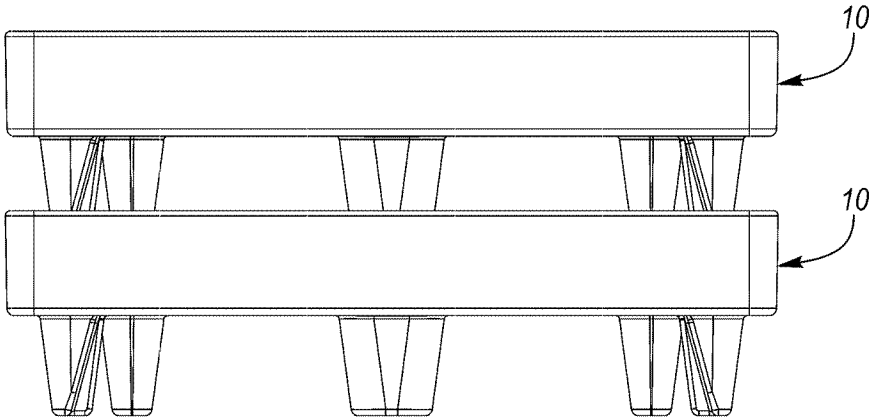
FIG. 11 is an end view of the pallets of FIG. 9.

As shown in FIGS. 9-11, with the frames 22 in the collapsed position in the deck 12, an identical pallet 10 can be stacked on the pallet 10. The feet 14 are received in the pockets 16 to reduced stacking height when empty and to improved stability. As one would understand, when the frames 22 are collapsed, the pallet 10 is capable of being used as one would use an ordinary pallet. In particular, the height of goods stacked on the pallet 10 is not limited by the height of the frames 22.

Figure 12:
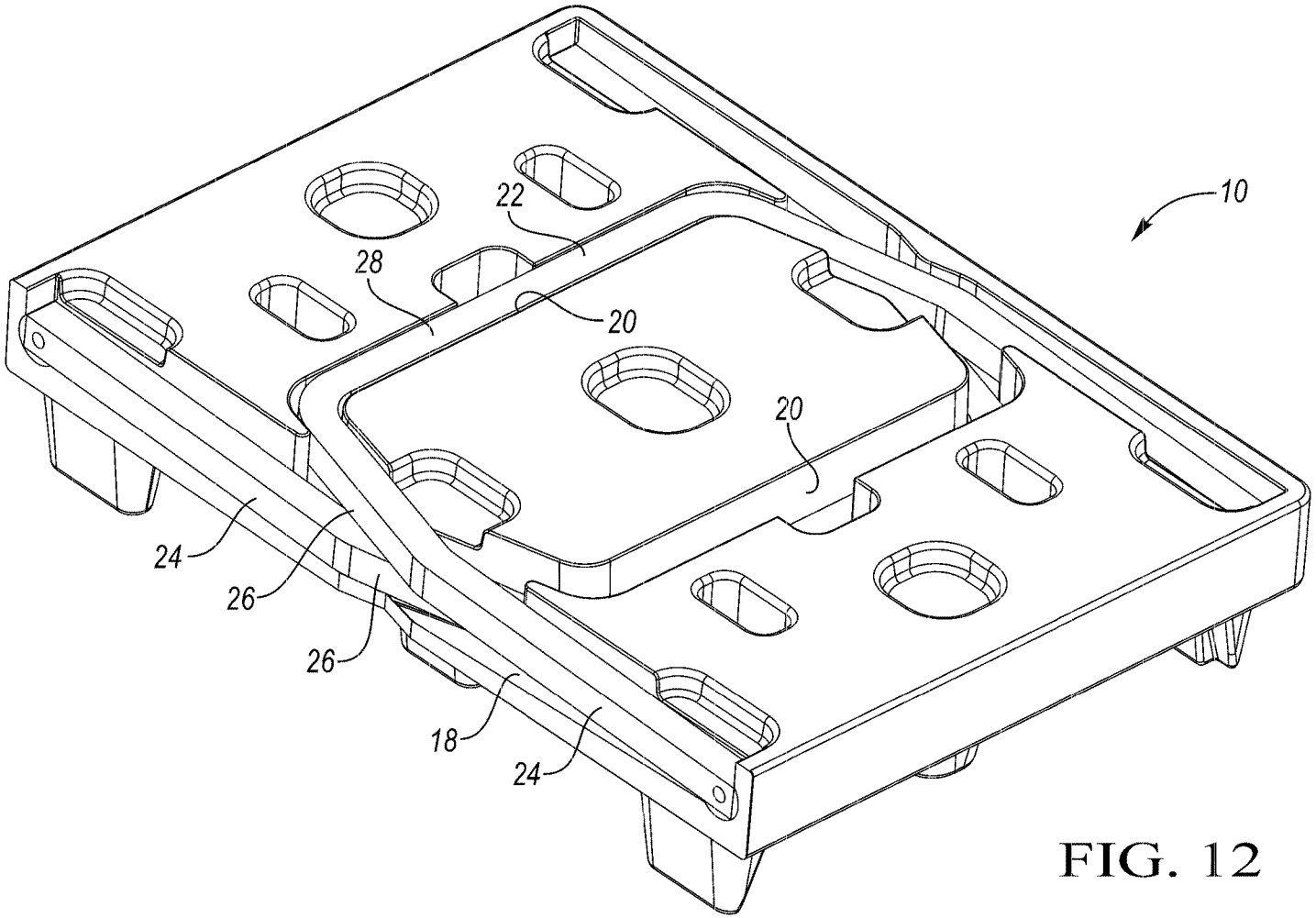
FIG. 12 is a perspective view of the pallet, similar to FIG. 4, but with a side edge removed for illustration.
Figure 13:
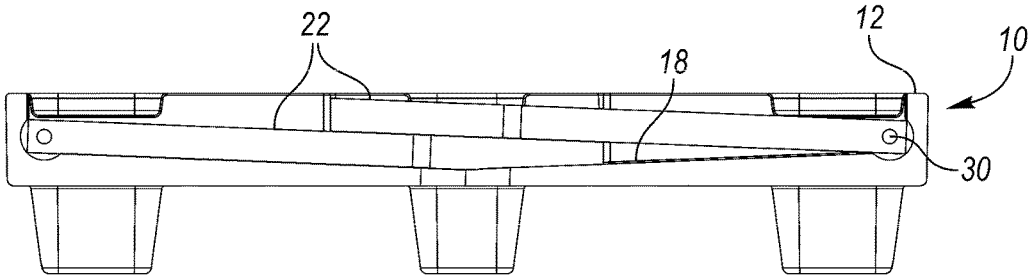
FIG. 13 is a side view of the pallet of FIG. 12 with the frames in the collapsed position.

In FIG. 12, the side edge of the deck 12 has been removed to show the frames 22 in the channel 18. As shown in FIG. 13, one of the frames 22 stacks partially on the other within the channel 18, with the middle portions 28 of the frames 22 received in the cross channels 20 in the deck 12.

Figure 14:
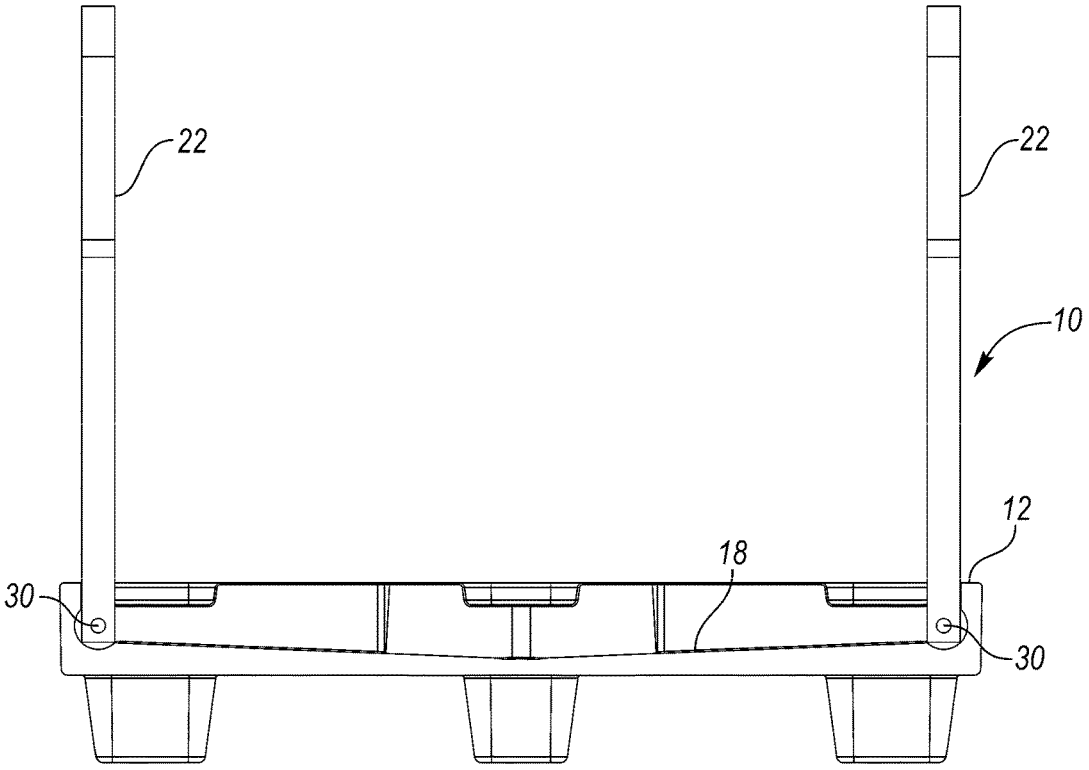
FIG. 14 is a side view of the pallet of FIG. 12 with the frames in the upright position.

In FIG. 14, the frames 22 are pivoted to the upright, support position (shown on the partially cut-away deck 12).

Figure 15:
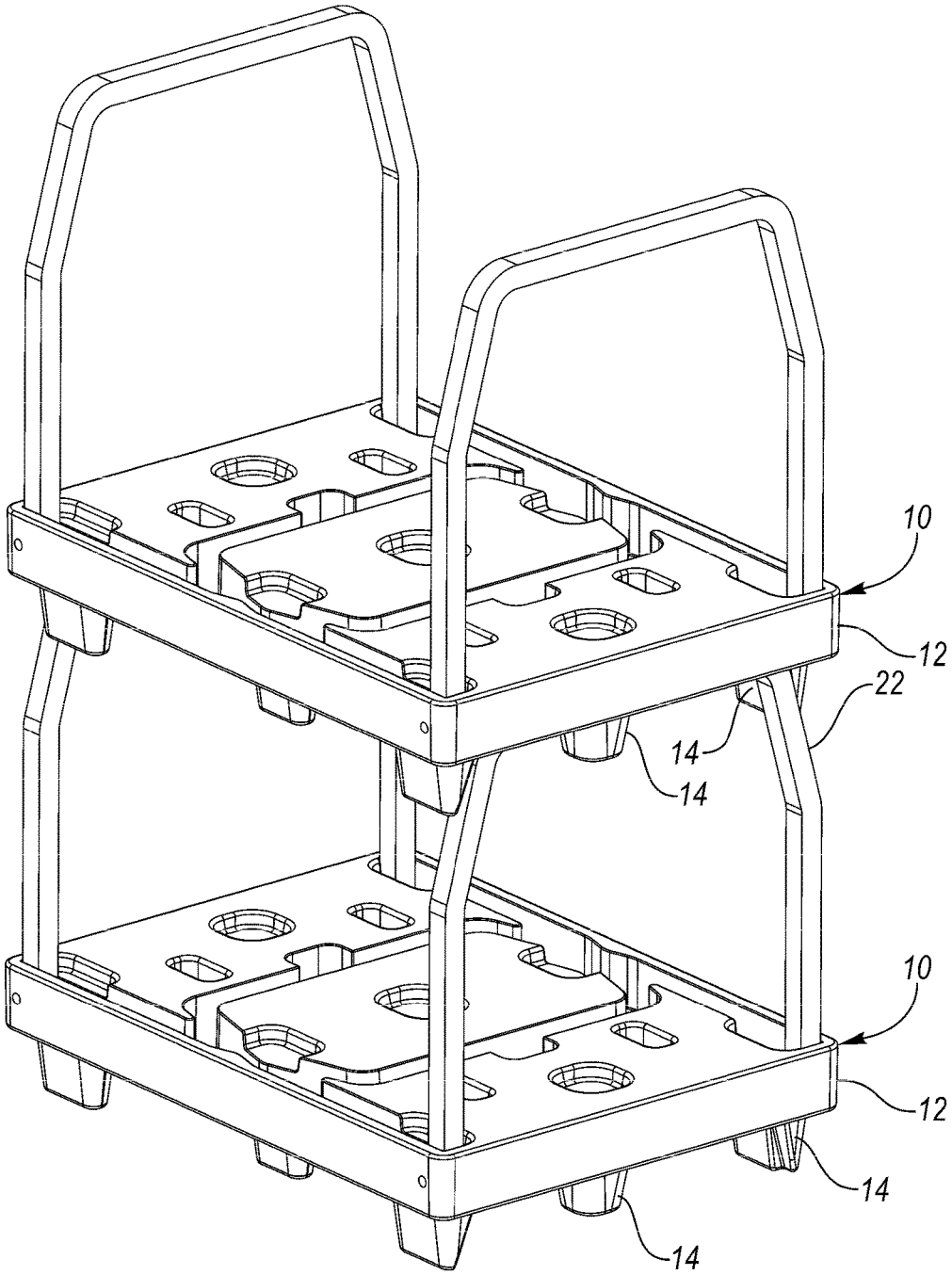
FIG. 15 shows the pallet with the frames in the upright position and an identical pallet stacked thereon.
Figure 17:
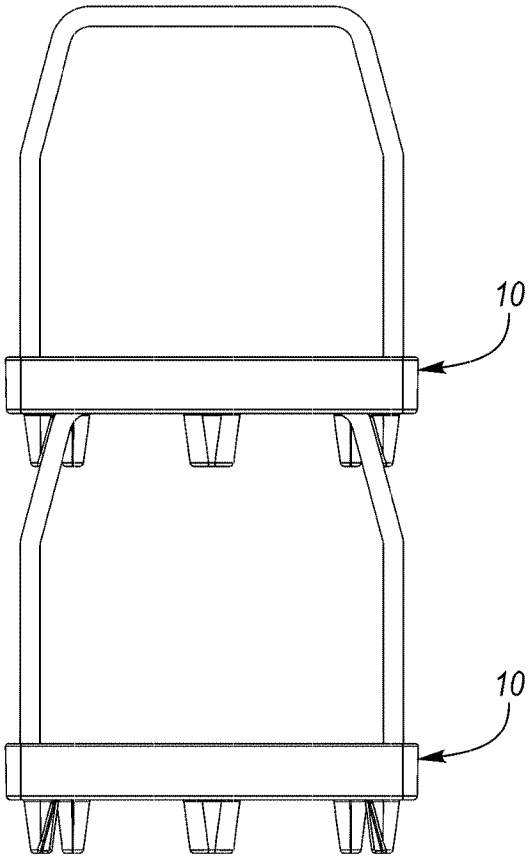
FIG. 17 is an end view of the pallets of FIG. 15.
Figure 16:
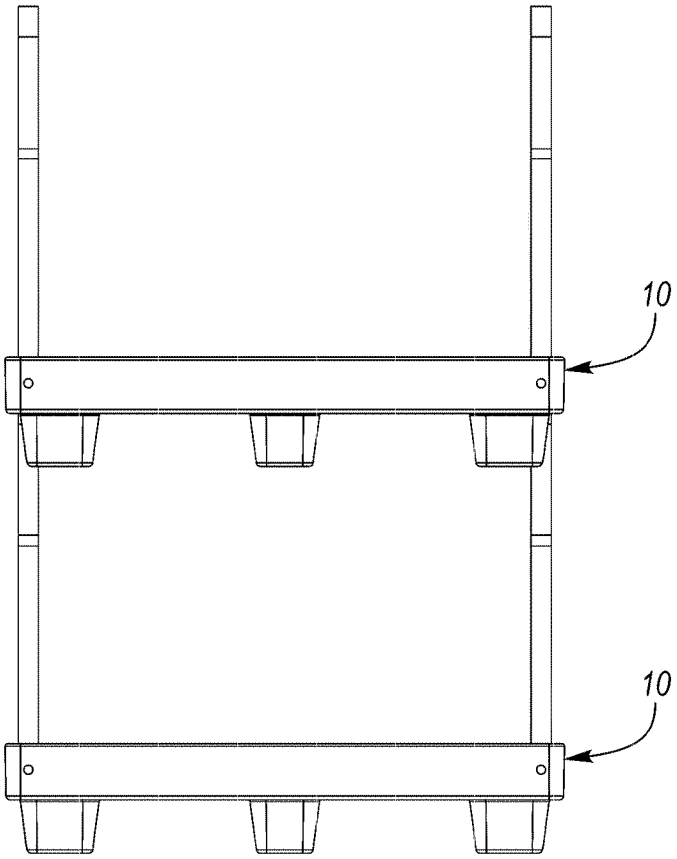
FIG. 16 is a side view of the pallets of FIG. 15.

As shown in FIG. 15, when the frames 22 are pivoted to the upright, support position, an identical pallet 10 can be supported on the frames 22. Goods can be shipped and stored on the decks 12 in the space created by the frames 22. FIGS. 16 and 17 are side and end views, respectively, of the stacked pallets 10.

Figure 18:
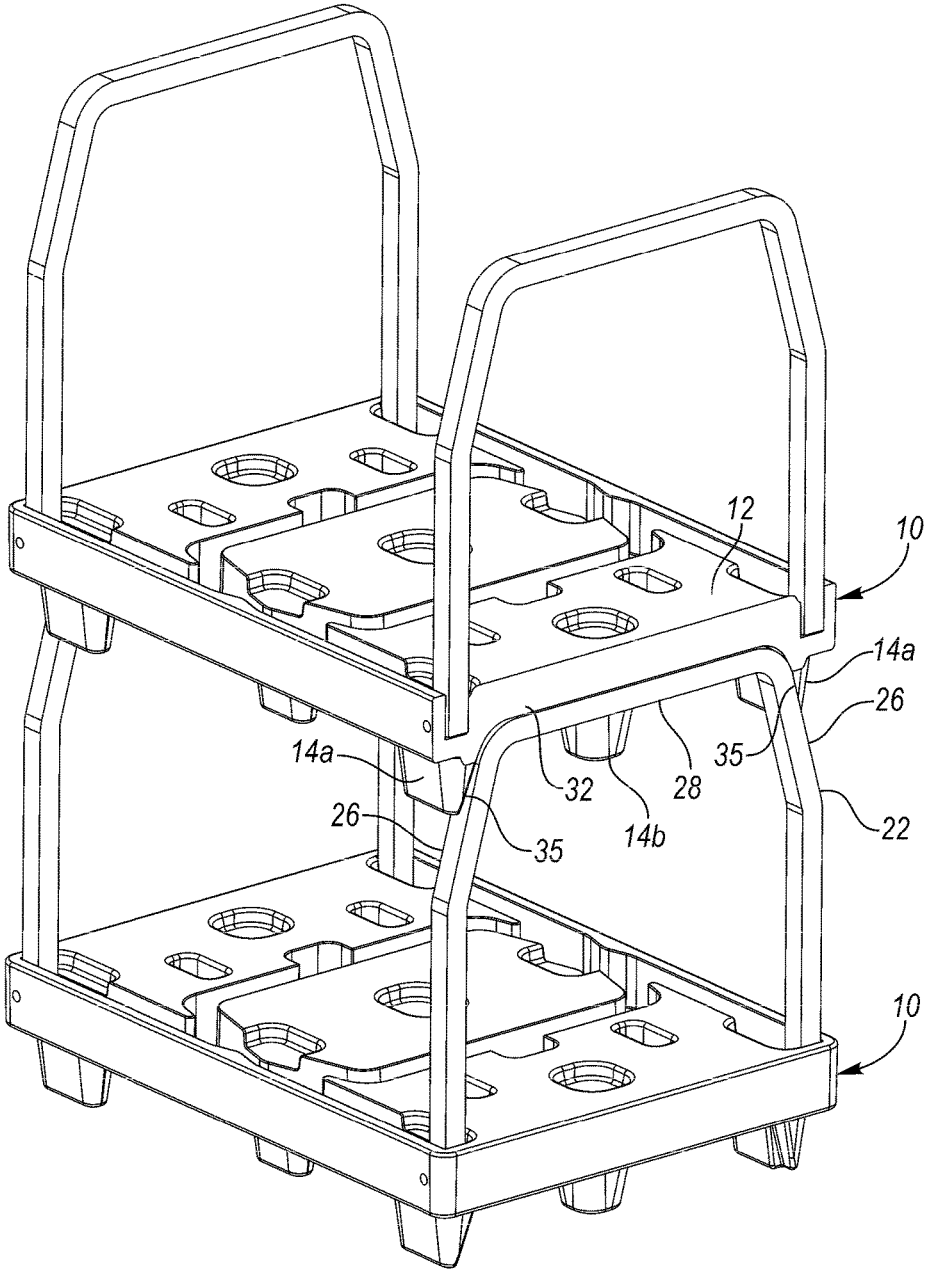
FIG. 18 shows the pallets of FIG. 15 with the end edge of the upper pallet cut away for illustration.
Figure 19:
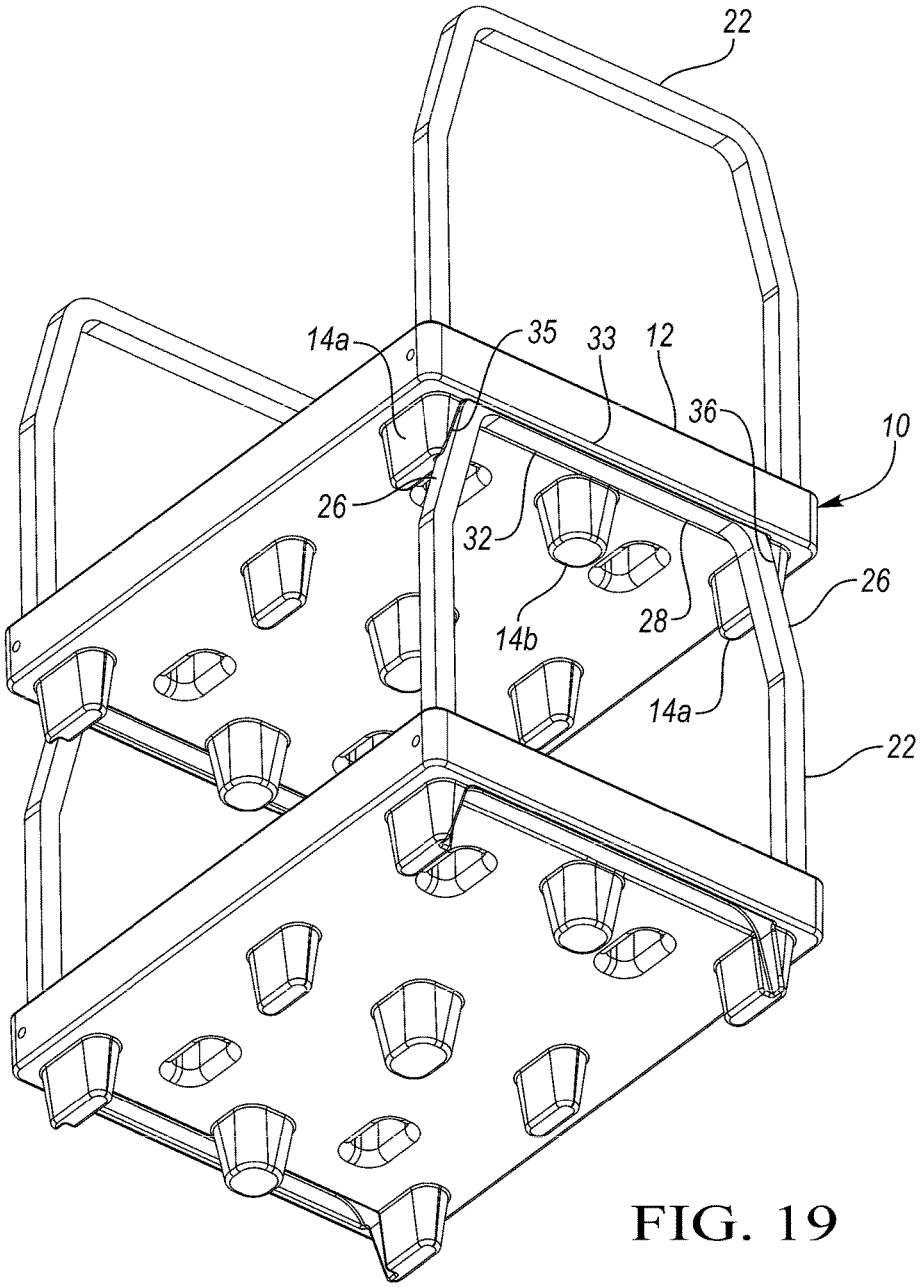
FIG. 19 is a bottom perspective view of the pallets of FIG. 15.

FIG. 18 shows the pallets 10 of FIG. 15 with the end edge of the upper pallet 10 cut away. FIG. 19 is a bottom perspective view of the pallets 10 of FIG. 15. As shown, the middle portion 28 of the frame 22 is received in the channel 32 between the foot 14*b* and the lip 33 (FIG. 19). The angled portions 26 of the frame 22 are received in the corner recesses 35 of the corner feet 14*a*. Thus, the frame 22 is captured between the corner feet 14*a*, the foot 14*b* and the lip 33 for a stable stack of pallets 10.

The deck 12 is preferably injection molded of plastic as a single piece or as separate upper and lower portions joined together (as known). Alternatively, the deck 12 may be rotomolded. The frames 22 may be formed of metal (e.g. aluminum) tubes or plastic tubes.

Figure 20:
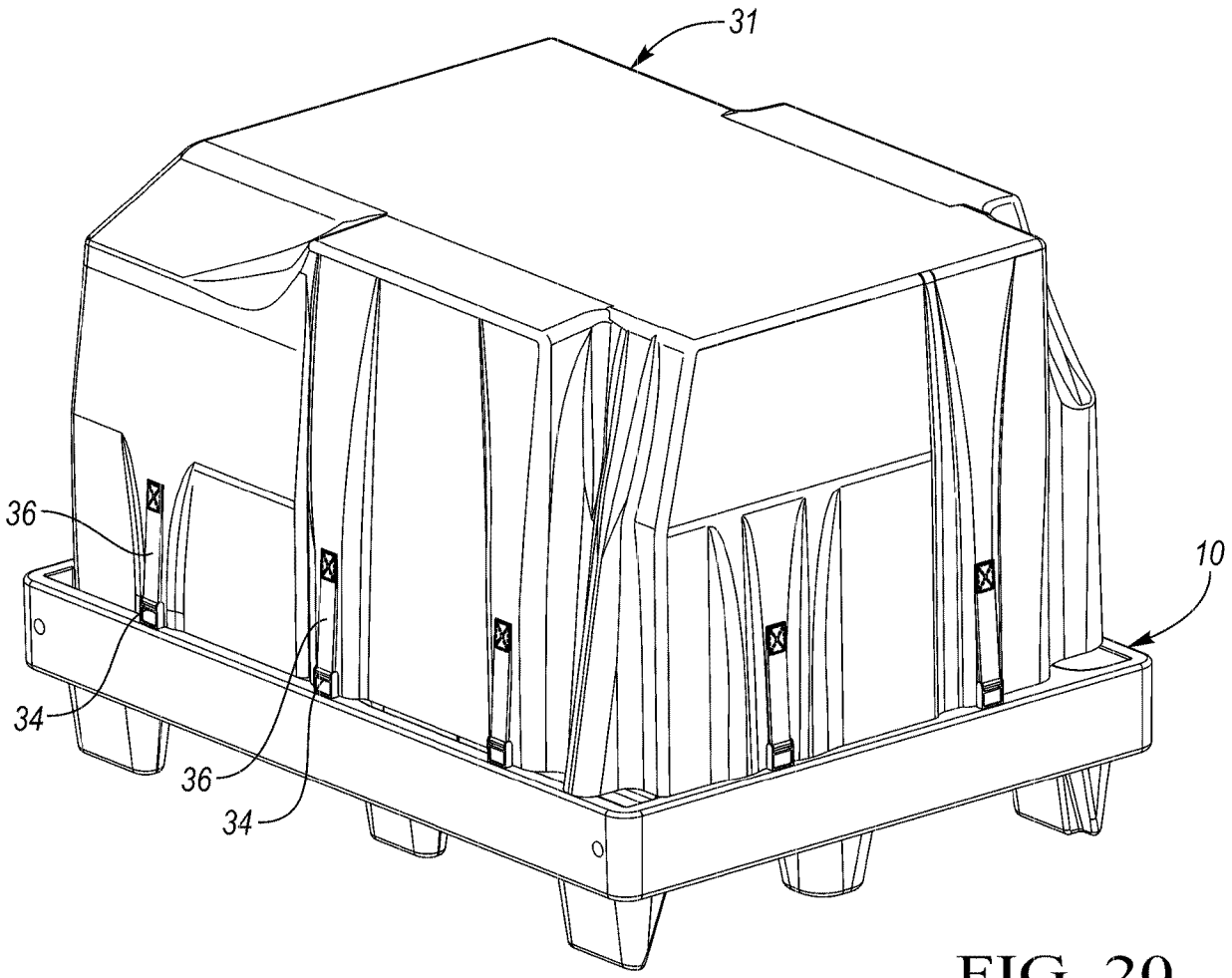
FIG. 20 is a perspective view of the pallet of FIG. 1 with a reusable wrap thereon.

FIG. 20 illustrates a reusable pallet wrap 30 according to this disclosure. The pallet wrap 30 is illustrated as being used in combination with the pallet 10. However, it should be understood that the pallet wrap 30 can be used with other types of pallets—in particular, pallets without collapsible frames 22.

Figure 21:
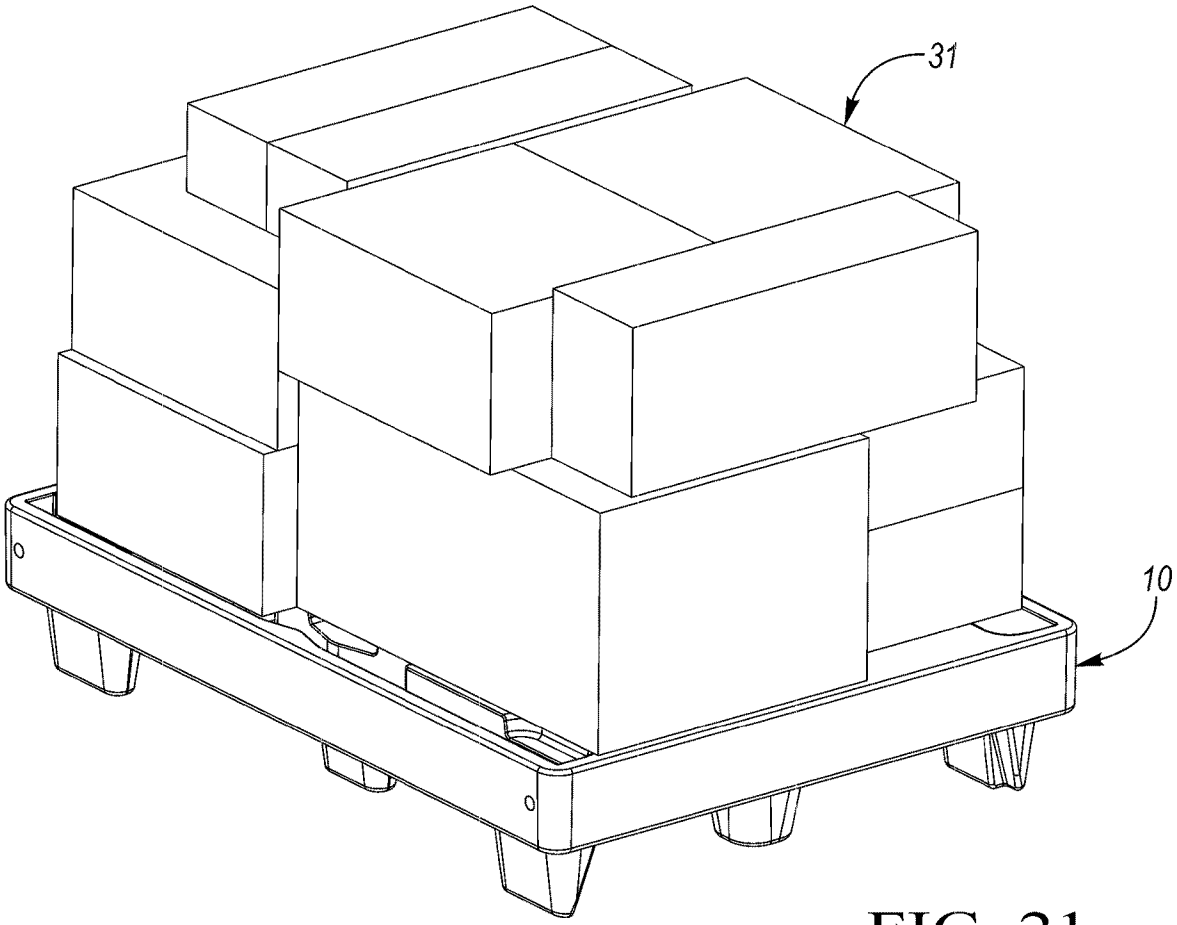
FIG. 21 shows the pallet of FIG. 20 with goods stacked thereon and the wrap removed.

The pallet wrap 30 in one example is provided by one or more layers of flexible material, and is configured to roughly conform to, and snugly fit over, a stack of goods 31 provided on the pallet 10 (FIG. 21). In one example, the pallet wrap is made at least partially of nylon. The pallet wrap 30 may be particularly useful for securing a non-uniform stack of goods 31, such as that illustrated in FIG. 21.

In a further embodiment of this disclosure, the pallet wrap 30 is a thermal pallet wrap. In this embodiment, the pallet wrap 30 includes at least one insulating layer to insulate the stack of goods 31. For instance, when transporting frozen goods, the pallet wrap 30 insulates the frozen goods (e.g., frozen pizza or ice cream) to provide thermal protection and keep them cold for an extended period of time. The pallet wrap 30 may also be used to prevent the unwanted freezing of certain goods.

With reference to FIG. 20, the pallet wrap 30 is secured to the pallet 10 by way of a plurality of clasps 34. The clasps 34 are attached to the pallet wrap 30 by a plurality of straps 36. Unlike traditional methods for wrapping pallets with plastic (such as shrink-wrap), in which the plastic typically is cut and destroyed when removing goods from the pallet, the pallet wrap 30 can be removed in a non-destructive manner (e.g., by unclipping the clasps 34). Therefore, the pallet wrap 30 is reusable.

Figure 22:
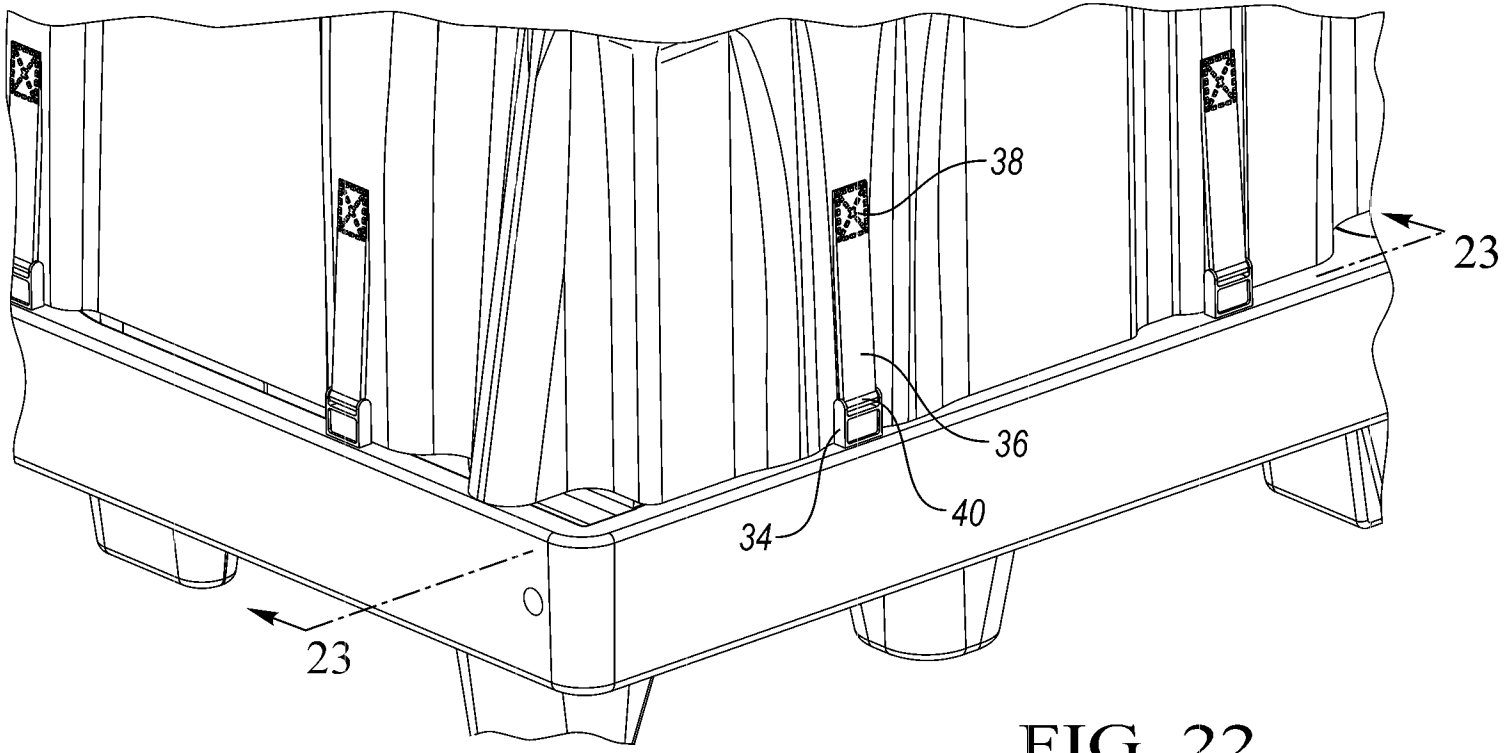
FIG. 22 is a close-up view of the clasps and straps connecting the wrap to the pallet of FIG. 20.

FIG. 22 is a close-up view of the clasps 34 and straps 36. In this example, the straps 36 are attached to the pallet wrap 30 by way of stitchings 38. The length of the straps 36 may be adjustable by way of an adjuster 40 to securely tie down the pallet wrap 30 over the goods 31.

Figure 23:
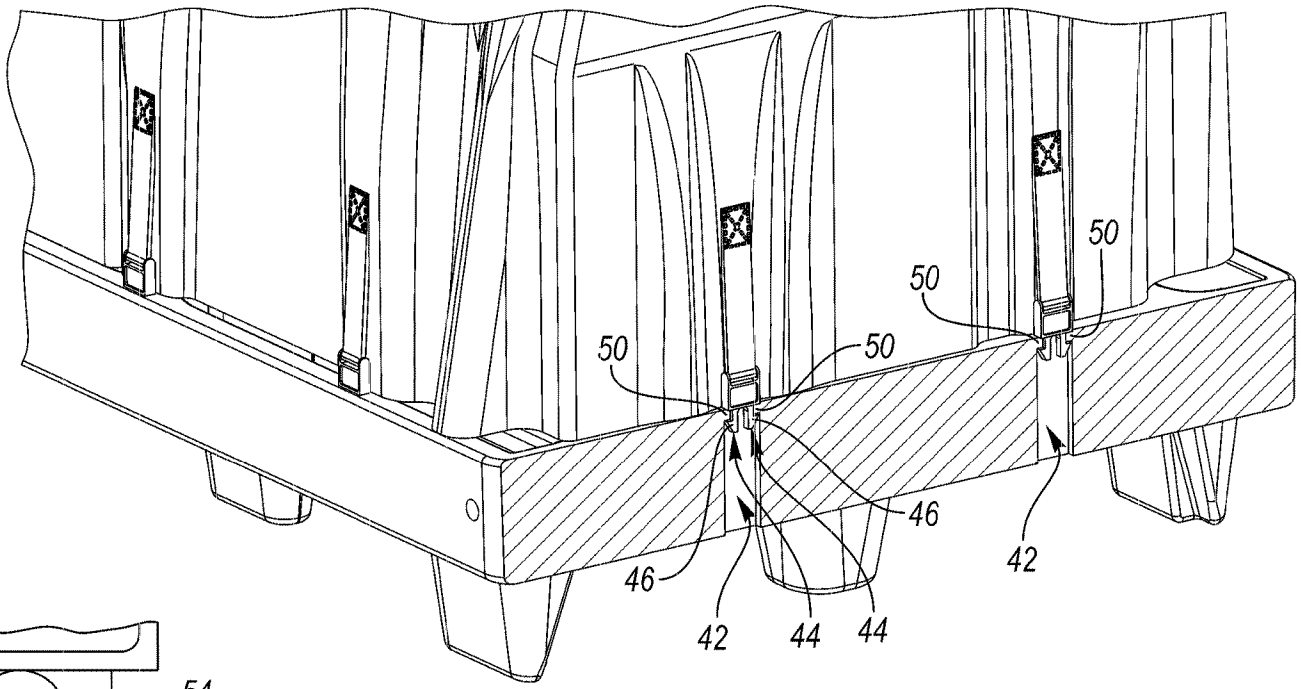
FIG. 23 is a cross-sectional view of FIG. 22 illustrating one example for engaging the clasps to the pallet.

FIG. 23 is a cross-sectional view illustrating one example for engaging the clasps 34 to the pallet 10. In this example, the pallet 10 includes a plurality of channels 42 for receiving the clasps 34.

Figure 24:
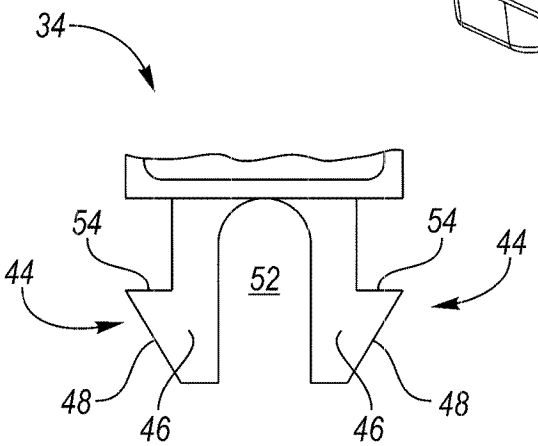
FIG. 24 is a detailed view of one of the clasps of FIG. 23.

With reference to FIGS. 23 and 24 (which shows the detail of the clasps 34), each of the clasps 34 includes a pair of attachment hooks 44 with fingers 46 projecting away from one another. The fingers 46 each include a ramped surface 48 on an outer side thereof to engage flanges 50 provided on opposite sides of the entrance of the channel 42. A gap 52 is provided between the attachment hooks 44 to allow the attachment hooks to flex toward one another when engaged with the flanges 50, as the attachment hooks 44 move into the channel 42. After passing beyond the flanges 50, the attachment hooks 44 are urged away from one another, and the engagement faces 54 of the attachment hooks 44 engage the flanges 50. The strap 36 is then adjusted to securely tie down the pallet wrap 30 relative to the pallet 10.

To remove the pallet wrap 30 from the pallet 10, the clasps 34 are unclipped (as mentioned above) by pinching the attachment hooks 44 toward one another, and then removing the clasps 34 from the channels 42. While perhaps not easily seen in FIG. 23, the attachment hooks 44 are accessible and can be pinched from an upper side of the pallet 10. Alternatively, the straps 36 may be removed from the clasps 34 via the adjuster 40, which may include a selectively engageable clamp, in which case the clasps 34 can remain attached to the pallet 10.

Figure 25:
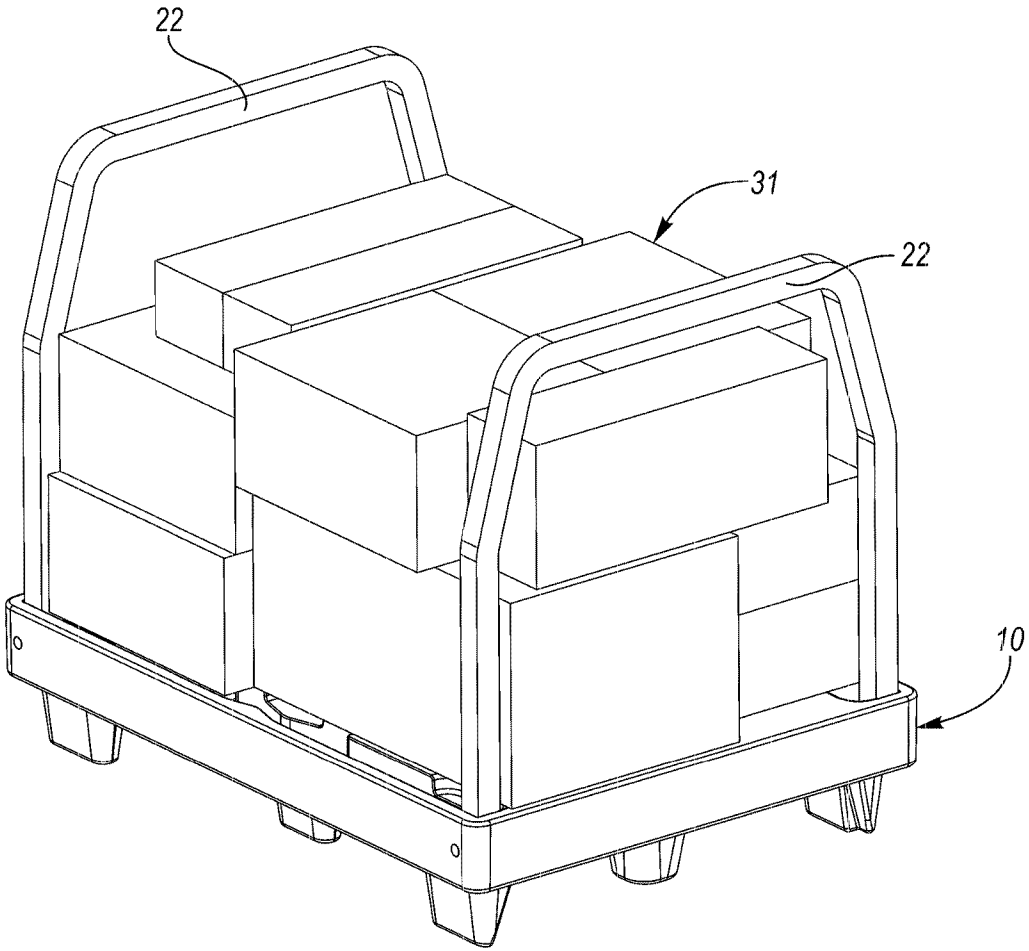
FIG. 25 shows the pallet with goods stacked thereon and the frames in the upright position.
Figure 26:
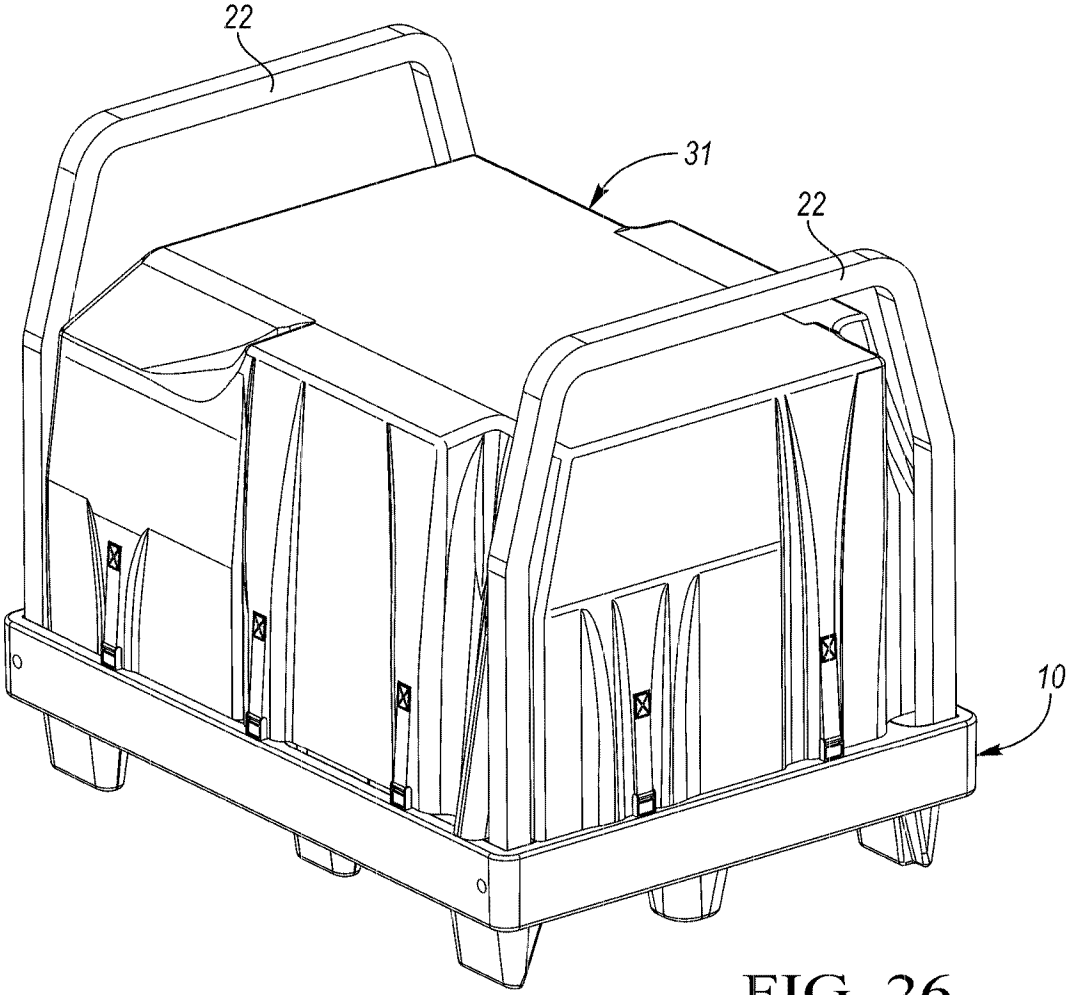
FIG. 26 shows the pallet of FIG. 25 with the wrap thereon.

FIGS. 25-26 illustrate the pallet wrap 30 being used with the frames 22 in the upright, support position. Again, the pallet wrap 30 can be used with other pallets that do not include frames.

Figure 27:
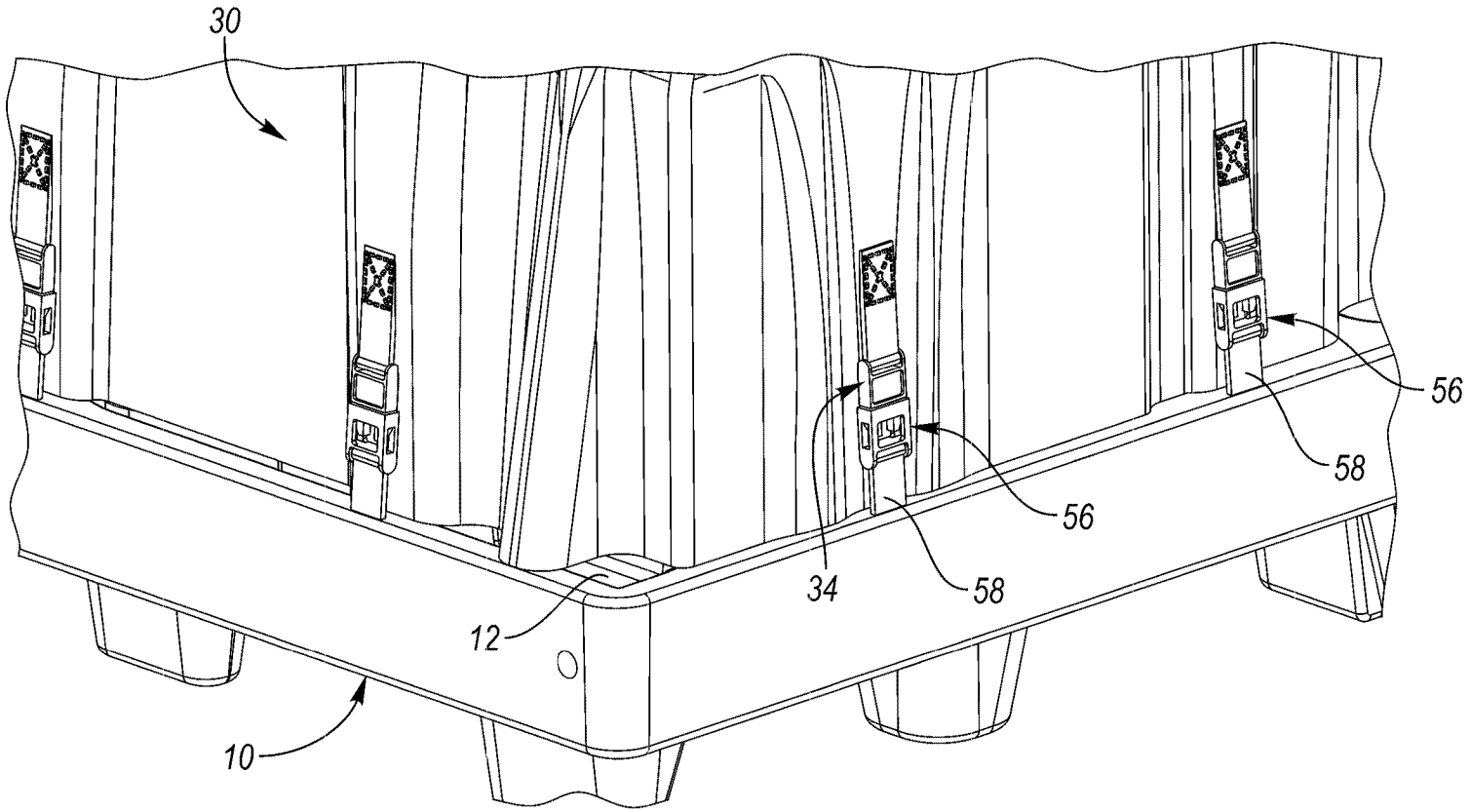
FIG. 27 illustrates an alternate example for engaging the clasps to the pallet.

FIG. 27 illustrates an alternate example for engaging the clasps 34 to the pallet 10. In FIG. 27, the clasps 34 are not directly received in the pallet 10 itself (as in FIG. 23). Instead, a plurality of receivers 56 are attached to the pallet 10 by way of a plurality of extensions 58. The receivers 56 are configured to securely engage with the clasps 34. The extensions 58 may be integrally molded with the pallet 10, or can be provided by separate straps (similar to the straps 36) connected to the pallet 10 in substantially the same way illustrated in FIG. 23.

It should be understood that the pallet wrap 30 described above can be used with both new and existing pallets. That is, existing pallets can be retrofit to include the channels 42 or the receivers 56 and extensions 58.

It should further be understood that, while two examples are illustrated herein, the pallet wrap 30 may be connected to a pallet in other ways that allow for non-destructive removal of the pallet wrap 30.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. For example, it may be desirable to configure the frames 22 to fold outward of the pallet 10 rather than inward onto the deck 12. This would provide improved access to the goods on the deck 12, such as for wrapping the goods.

What is claimed is:

1. A pallet comprising:

a deck including at least one recess;

a plurality of feet below the deck; and at least one frame extending upward from the deck, wherein each of the at least one frames includes a pair of upright portions having a cross portion connecting outer ends of the upright portions, the at least one frame pivotably secured to the deck, such that the at least one frame is pivotable from an upright position to a collapsed position within the at least one recess, wherein the at least one recess of the deck is capable of receiving the pair of upright portions and the cross portion of the at least one frame in the collapsed position.

2. The pallet of claim 1 wherein the at least one frame includes two frames, one proximate each end of the deck, wherein the two frames are pivotable to a collapsed position within the at least one recess in the deck.

3. The pallet of claim 1 wherein the cross portion includes an angled portion extending upward and inward from each upright portion and a horizontal portion connecting the angled portions.

4. The pallet of claim 1 wherein lower ends of the pair of upright portions are pivotably connected to the deck.

5. The pallet of claim 4 wherein the deck includes a plurality of pockets formed therein for receiving the feet of an identical pallet nested thereon.

6. The pallet of claim 1 wherein the at least one frame includes two frames, each pivotable between an upright position and a collapsed position, and wherein the two frames overlap one another in the collapsed position.

7. The pallet of claim 6 wherein the two frames are pivotably secured to the deck.

8. A pallet comprising:

a deck;

a plurality of feet below the deck; and a plurality of frames extending upward from the deck, wherein an underside of the deck includes a plurality of recesses for receiving the plurality of frames of an identical pallet stacked therebelow.

9. The pallet of claim 8 wherein the plurality of feet include a pair of end feet and wherein the recess on the underside of the deck includes an elongated channel and a recess in each of the pair of end feet, such that the at least one frame of the identical pallet would be received in the elongated channel and in the recesses in the pair of end feet.

10. A pallet comprising:

a deck including at least one recess;

a plurality of feet below the deck, wherein the plurality of feet include a pair of end feet adjacent each opposing end edge of the deck and a pair of center feet between the end feet, wherein the pair of center feet are closer to one another than the pair of end feet are to one another; and at least one frame extending upward from the deck, the at least one frame pivotably secured to the deck, such that the at least one frame is pivotable from an upright position to a collapsed position with the at least one recess, wherein the at least one recess of the deck is capable of receiving the at least one frame in the collapsed position.

11. The pallet of claim 1 further including a flexible wrap securable to the deck over goods stacked thereon.

12. A pallet comprising:

a deck having a pair of opposed end edges and a pair of opposed side edges;

a plurality of feet below the deck, wherein the deck includes a plurality of pockets formed therein for receiving the feet of an identical pallet nested thereon;

at least one frame extending upward from the deck; and a flexible wrap securable to the deck over goods stacked thereon, wherein the flexible wrap includes a plurality of connectors removably securable to a plurality of points along the pair of opposed end edges and a pair of opposed side edges of the deck.

13. A pallet comprising:

a deck including an upper surface for supporting goods thereon, the deck including a plurality of integrally formed first connectors;

supports below the deck, the supports supporting the deck above a floor, wherein the supports include four corner supports proximate corners of the deck, wherein the deck includes a plurality of pockets formed therein for receiving the supports of an identical pallet nested thereon;

a wrap removably securable to the deck; and a plurality of second connectors for removably securing the wrap to the first connectors in the deck, wherein the second connectors and first connectors can be snap-fit connected to one another.

14. The pallet of claim 13 wherein the plurality of first connectors are disposed about a periphery of the deck.

15. The pallet of claim 1 wherein the at least one frame is pivotably secured to the deck by a hinge below an upper support surface of the deck.

16. The pallet of claim 15 wherein the at least one frame is substantially flush with the upper support surface of the deck when the at least one frame is in the collapsed position.

17. The pallet of claim 8 wherein the plurality of feet extend downward below the deck further than the recess.

18. The pallet of claim 17 wherein the recess is partially formed in at least one of the plurality of feet.

19. The pallet of claim 8 wherein the deck includes a plurality of openings aligned with the plurality of feet so that the plurality of feet of an identical pallet could be at least partially nested therein.

* * * * *